US008607880B2

(12) United States Patent
Smith et al.

(10) Patent No.: US 8,607,880 B2
(45) Date of Patent: Dec. 17, 2013

(54) GAS LIFT PLUNGER ACCELERATION ARRANGEMENT

(75) Inventors: Jesse L. Smith, Kingfisher, OK (US); David A. Green, Highlands Ranch, CO (US); Robert E. Bender, Evergren, CO (US)

(73) Assignee: Well Master Corp, Golden, CO (US)

( * ) Notice: Subject to any disclaimer, the term of this patent is extended or adjusted under 35 U.S.C. 154(b) by 340 days.

(21) Appl. No.: 12/807,808

(22) Filed: Sep. 14, 2010

(65) Prior Publication Data

US 2011/0073322 A1 Mar. 31, 2011

Related U.S. Application Data

(60) Continuation-in-part of application No. 12/217,756, filed on Jul. 8, 2008, now Pat. No. 7,793,728, which is a division of application No. 11/350,367, filed on Feb. 8, 2006, now Pat. No. 7,395,865.

(60) Provisional application No. 60/593,914, filed on Feb. 24, 2005.

(51) Int. Cl.
*E21B 43/12* (2006.01)
*E21B 34/06* (2006.01)

(52) U.S. Cl.
USPC ..... 166/372; 166/68; 166/105.2; 166/108; 166/333.1; 166/373; 166/386

(58) Field of Classification Search
None
See application file for complete search history.

(56) References Cited

U.S. PATENT DOCUMENTS

| | | | | | |
|---|---|---|---|---|---|
| 4,889,473 | A * | 12/1989 | Krueger | ..... | 417/56 |
| 6,007,314 | A * | 12/1999 | Nelson, II | ..... | 417/456 |
| 6,971,856 | B1 * | 12/2005 | Mayfield et al. | ..... | 417/56 |
| 2003/0047316 | A1 * | 3/2003 | Bosley | ..... | 166/372 |
| 2006/0231247 | A1 * | 10/2006 | Schneider et al. | ..... | 166/68 |

* cited by examiner

*Primary Examiner* — Zakiya W Bates
(74) *Attorney, Agent, or Firm* — Don Halgren

(57) ABSTRACT

An elongated plunger arrangement for moving up and down in a tubing string and a plunger lift system for an oil well and a gas well, the plunger having an upper portion, an intermediate portion and a lower portion, all of the portions having an elongated longitudinally directed bore or cavity therewithin, the plunger also having a direction accelerating arrangement therewithin, the direction accelerating arrangement comprising an elongated acceleration inducing valve containing shift rod extending through the elongated bore, wherein the shift rod is longer than the elongated plunger.

10 Claims, 4 Drawing Sheets

GAS LIFT PLUNGER ACCELERATION ARRANGEMENT

BACKGROUND OF THE INVENTION

The present invention relates to plunger lift systems for oil and gas wells, and particularly to an accelerated gas lift plunger and is a continuation in part of U.S. Ser. No. 12/217,756 filed Jul. 8, 2008 now U.S. Pat. No. 7,793, 728 which is a divisional application of the Ser. No. 11/350,367 filed in Feb. 8, 2006, now U.S. Pat. No. 7,395,865 which claims priority from provisional application 60/593,914 filed Feb. 24, 2005, all of which are incorporated herein by reference in their entirety.

FIELD OF THE INVENTION

Background Art

Plunger lift systems are artificial liquid lift systems for oil and gas wells. U.S. Pat. No. 6,200,103 to Bender and U.S. Pat. No. 7,395,865 also to Bender, incorporated herein by reference, disclose gas lift plungers having a slender elongated plunger body. The plunger body has a plurality of spaced, shaped circumferential grooves. The grooves are shaped to increase gas/fluid turbulence and thereby improve plunger lift and reduce the flow of liquid around the plunger.

It is an object of the present invention to overcome the disadvantages of the prior art.

It is a further object of the present invention to improve the speed of a plunger as it travels through an oil or gas well.

It is yet a still further object of the present invention to improve the speed of a plunger as it falls within a gas well while maintaining the normal functions of that plunger within that well.

It is still yet an object of the present invention to provide a valving system within a plunger which facilitates the cycle time of a plunger's operation.

BRIEF SUMMARY OF THE INVENTION

A plunger for an oil or gas well has a cylindrically elongated plunger body with a top portion, an intermediate portion and a lower portion. The intermediate portion includes a plurality of longitudinally spaced, shaped circumferential grooves defined by recessed surfaces interspersed between sections of the peripheral surface of the plunger body.

The plunger body has a cylindrical interior cavity at its top or uppermost end thereof and extending longitudinally through to its lower or bottommost end thereof. The generally elongated cylindrical body or plunger housing has a plurality of outwardly directed air discharge holes arranged adjacent its circumferential grooves coming from its interior cavity. The interior cavity includes a large valve chamber close to the upper end of the plunger. A plurality of exit holes are arranged through the wall of the body of the plunger adjacent the uppermost end of the valve chamber thereat.

An elongated shift rod extends through the length of the interior cavity of the plunger and extends out at least one end thereof. The elongated shift rod is longer than the plunger. The elongated shift rod, in one preferred embodiment thereof has a pair of annular detents extending circumferentially around an upper end of the shift rod. The shift rod has an enlarged manifold extending therearound, just below the annular detents. The enlarged manifold is arranged to snugly mate within and slide longitudinally within the enlarged valve chamber. The enlarged manifold or valve body has a plurality of generally longitudinally directed bores extending therethough, in a circumferential spaced apart arrangement therearound.

The upper portion of the plunger body is attached to the lower portion of the body of the plunger by a threaded coupler arrangement therebetween. The lower end of the elongated shift rod has a plurality of generally radially directed spacer fins extending longitudinally thereof. The spacer fins have a radial edge which slide within the lower end of the interior cavity of the plunger. There is an arcuate space between the spacer fins at the lower end of the shift rod to permit the passage of fluid therethrough.

In one preferred embodiment of the present invention, a biased ball may be engaged with one of the two spaced longitudinally apart annular detents or grooves arranged around the upper end of the shift rod, depending upon the position of the shift rod and the valve manifold within the enlarged chamber therewithin.

When the plunger is falling through a tubing string in a gas or oil well, the shift rod is effected so as to extend beyond the lower end of the plunger body, so that a portion of the spacer fins extend therefrom. There is an annular passageway between the shift rod and the interior cavity of the plunger. Gas and liquid are permitted to enter an annular passageway between the shift rod and the interior cavity of the plunger, via entry between the adjacent spaced apart fins, and travels through the generally longitudinally directed bores arranged within the valve body. That fluid is permitted to escape out the exterior holes through the plunger wall at the upper end of the enlarged cylinder cavity or chamber in which the valve body reciprocally travels, thus making the plunger's fall or downward travel through the tubing string much faster, reducing its operation cycle time, thus improving the output of the oil or gas well. The shift rod may be maintained in that lowermost orientation, extending through the lowermost end of the plunger body, in one preferred embodiment, by virtue of the ball being biased in the uppermost or first annular detent at the uppermost end of the shift rod.

When the plunger strikes the bottom hole bumper or spring stop at the lower end of the string, the shift rod is struck and caused to be moved longitudinally (upwardly) within the inner elongated cylindrical cavity of the plunger, thus driving the valve body upwardly towards the upper end of the plunger and towards the upper end of the enlarged chamber, effectively blocking off the fluid escape holes from that enlarged chamber thereadjacent. Thus, gaseous/fluid pressure may be caused to build up within the plunger and around its outer rings externally thereof, and advance the plunger back towards the upper end of the gas well so as to strike the lubricator by the upper or tip end of the shift rod, and go through its operating cycle again. During the plunger's upward travel within the tubing string, the shift rod may be held in its upward orientation by virtue of the biased ball being pressed into the second or lowermost annular detent which is longitudinally beneath the first or upper annular detent.

The invention thus comprises an elongated plunger arrangement for moving up and down in a tubing string and a plunger lift system for an oil well and a gas well, the plunger having an upper portion, an intermediate portion and a lower portion, all of the portions having an elongated longitudinally directed cavity therewithin, the plunger also having a direction accelerating arrangement, the direction accelerating arrangement comprising: an elongated acceleration inducing shift rod extending through the elongated cavity, wherein the shift rod is longer than the elongated plunger. The elongated shift rod preferably has an enlarged valve body portion arranged adjacent upper end thereof. The elongated shift rod preferably has a plurality of arcuate fins disposed about a lower end thereof. The elongated shift rod is axially displacable within the elongated cavity in the body of the plunger. The axial displacement of the elongated shift rod is controlled. The displacement of the elongated shift rod acts to open a valve within the plunger. The displacement of the elongated shift rod acts to close a valve within the plunger. The elongated shift rod may have a detent arrangement at its upper end thereof. The plunger may have a releasable biasing means at its upper end, to engage the detent arrangement at the upper end of the elongated shift rod. The valve body has a fluid and/or gaseous flow arrangement extending thereacross. The fluid and gaseous flow arrangement comprises a plurality of fluid flow channels. The valve body is longitudinally displaceable within an enlarged cavity within the upper end of the plunger. The large cavity within the upper end of the plunger preferably has a controlled fluid discharge arrangement therein. The controlled fluid discharge arrangement comprises at least one gas exit port arranged through the wall of the upper end of the plunger body.

The invention also may comprise a method of accelerating the fall of an elongated plunger in an oil or gas well system, comprising one or more of the following steps: arranging an elongated, axially displaceable shift rod within an elongated longitudinally directed cavity of the plunger, which shift rod is longer than the elongated plunger; extending the elongated shift rod downwardly beyond the lower end of the elongated plunger during a fall of that plunger within an oil or gas well system; and opening a valve within that plunger during that fall the plunger so as to permit a gaseous flow of fluid through that plunger during its descent in the well; impacting the lower end of the well by the lower end of the shift rod so as to axially displace the shift rod upwardly within the body of the plunger, wherein the upward displacement of the shift rod action to close the valve in the plunger thereby shuts off the flow of gas through that plunger in its ascent back up to the top of the well.

BRIEF DESCRIPTION OF THE DRAWINGS

The objects and advantages of the present invention will become more apparent when viewed in conjunction with the following drawings, in which.

DETAILED ACTION OF THE PREFERRED EMBODIMENTS

Figure 1:
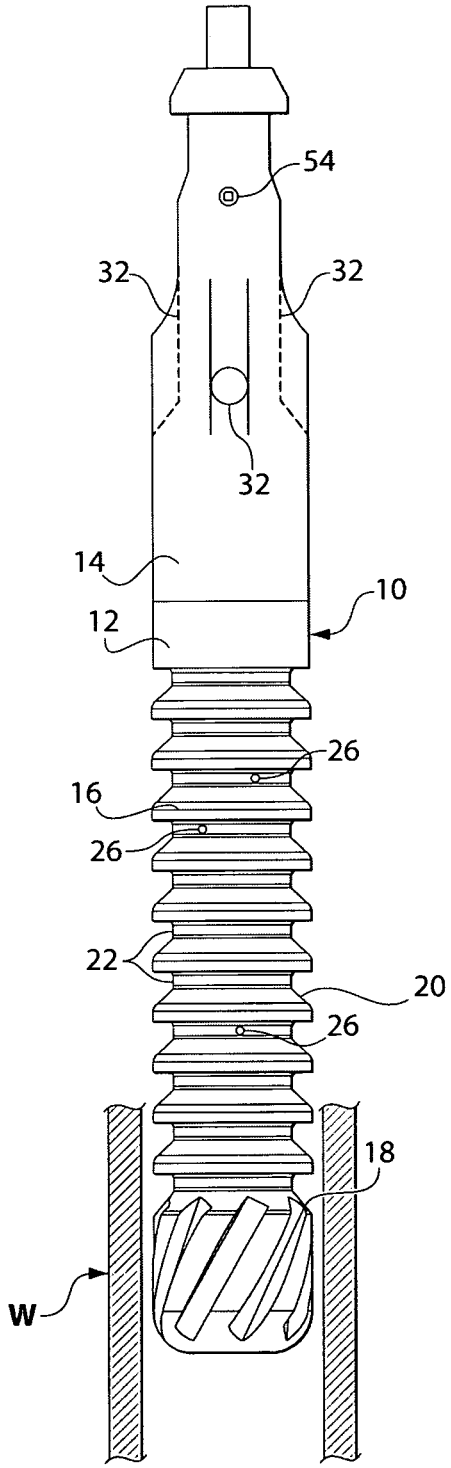
FIG. 1 is a side elevation view of a plunger constructed according to the principles of the present invention.

Referring now to the drawings seen detail and particularly to FIG. 1 there is shown the present invention which includes a plunger 10 for an oil or gas well "W" has a cylindrically elongated plunger body 12 with a top portion 14, an intermediate portion 16 and a lower portion 18. The intermediate portion 16 includes a plurality of longitudinally spaced, shaped circumferential grooves 20 defined by recessed surfaces 22 interspersed between sections of the peripheral surface of the plunger body 12.

Figure 2:
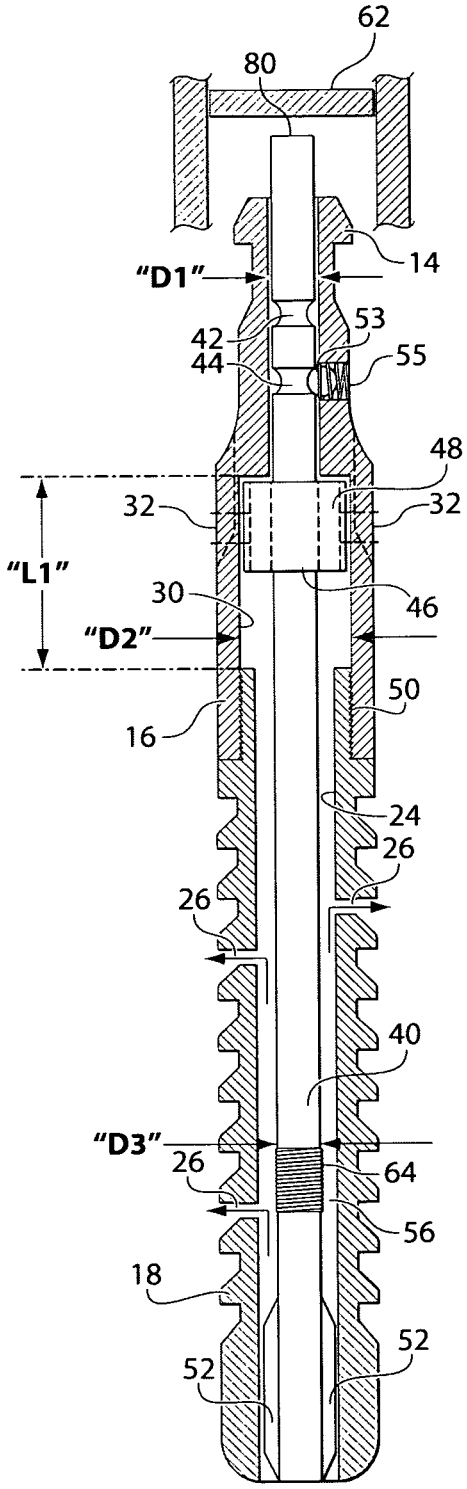
FIG. 2 is a longitudinal sectional view of the plunger shown in FIG. 1, as it approaches a lubricator at the upper end of a tubing string.
Figure 3:
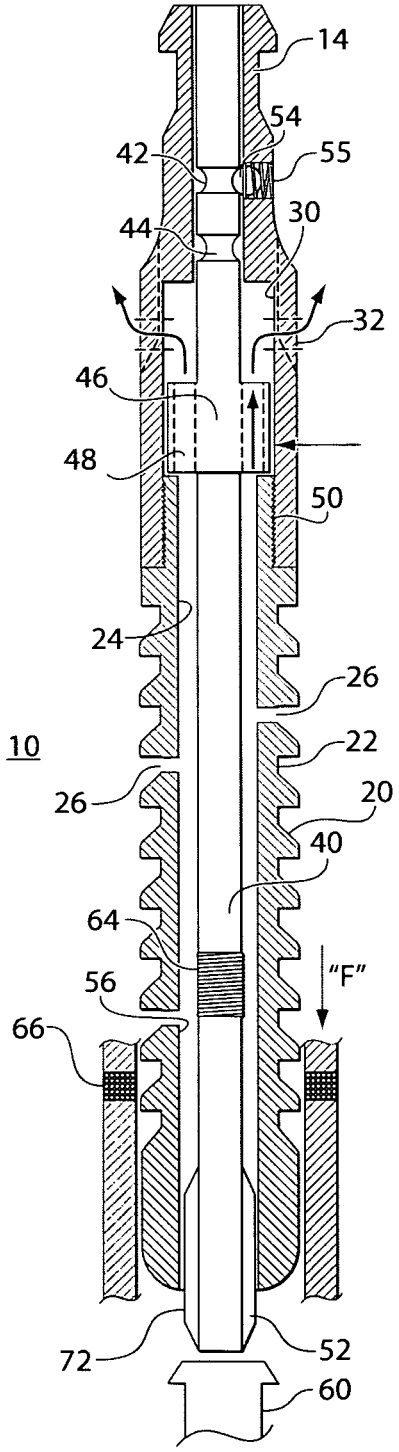
FIG. 3 is a longitudinal sectional view of a plunger similar so that shown in FIG. 2, with its shift rod extending out the lowermost end of the plunger body ready to strike the bottom hole or spring stop in a well.

The plunger body 12 has an elongated, cylindrically shaped, multiple diametered, interior bore or cavity 24 beginning at its top or uppermost end 14 thereof and extending longitudinally through to its lower or bottommost end 18 thereof, as represented in FIGS. 2 and 3. The generally elongated cylindrical body or plunger housing 12 has a plurality of outwardly directed air discharge holes 26 arranged adjacent its circumferential grooves 20 coming from its interior bore or cavity 24, as represented in FIGS. 1, 2 and 3. The interior bore or cavity 24 has a first diameter D1 in the upper portion 14, which is enlarged to a wider diameter D2 in a large cylindrically shaped valve chamber 30, the chamber 30 having a length "L1" within a limited portion of the upper end 14 of the plunger 10, as represented in FIGS. 2 and 3. A plurality of exit holes 32 are arranged through the wall of the body 14 of the plunger 10 adjacent the uppermost and through the walls of the valve chamber 30 to permit the controlled escape of fluid from that valve chamber 30.

Figure 4:
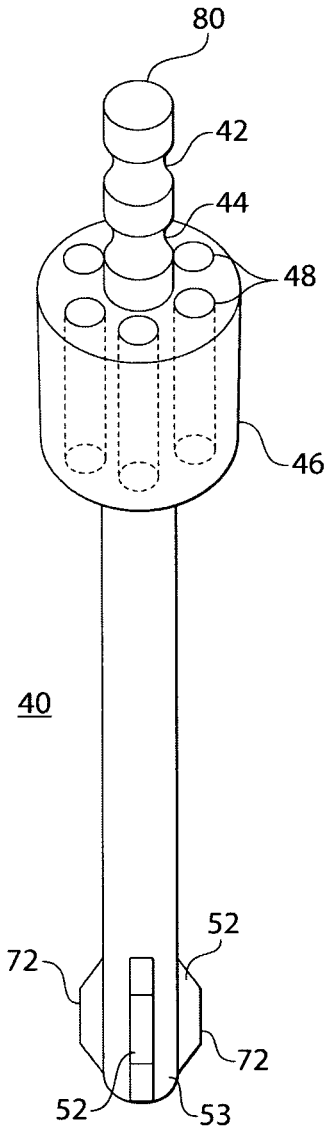
FIG. 4 is a perspective view of the elongated shift rod which is longitudinally displaceable within the inner cavity of the elongated plunger.

An elongated shift rod 40, shown in section in FIGS. 2 and 3, and shown in perspective, in FIG. 4, extends through the length of the interior bore or cavity 24, the shift rod 24 having a diameter "D3" within the intermediate and lower portions 16 and 18 of the body 12 of the plunger 10, and alternatively extends out, via a movement means (described hereinbelow), through at least one end thereof, as shown in FIGS. 2 and 3. The elongated shift rod 40 is longer than the plunger 10. The elongated shift rod 40, in one preferred embodiment thereof, shown in FIGS. 2-4, has a first or upper annular detent 42, and a second or lower annular detent 44, both extending circumferentially around an upper end of the shift rod 40. The shift rod 40 has an enlarged, preferably cylindrically shaped body or manifold 46 extending therearound, just below the annular detents 42 and 44, as shown in FIG. 4. The enlarged manifold 46, of cylindrical shape in cross-section, having a diameter just under diameter "D2", is arranged to snugly mate within and reciprocably slide longitudinally within the enlarged valve chamber 30. The enlarged manifold 46 has a plurality of generally longitudinally directed, fluid conducting bores 48 (or channels, such as for example, grooves in a further preferred embodiment) extending therethough, in a circumferential, spaced apart arrangement therearound, as is best seen in FIG. 4.

The upper portion of the plunger body 14 is attached to the intermediate 16 (and the lower portion 18) of the body of the plunger 10 by a threaded coupler arrangement 50 therebetween. The lower end of the elongated shift rod 40 has a plurality of generally radially directed spacer fins 52 extending longitudinally thereof, as best represented in FIGS. 3 and 4. The spacer fins 52 have a radial edge 72 which slide within the lower end of the interior bore or cavity 24, which cavity 24 has a diameter therein of "D3", of the plunger 10, where "D2">"D3">"D1". There is an arcuate space 53 between the spacer fins 52 at the lower end of the shift rod 40 to permit the passage of gases of therethrough.

In one preferred embodiment of the present invention, a biased ball 54, shown in FIGS. 1, 2 and 3, biased radially inwardly by a spring means 55, may be engaged with one of the two spaced longitudinally apart annular detents 42 and 44 arranged around the upper end of the shift rod 40, depending upon the position of the shift rod 40 and the valve body or manifold 46 within the enlarged chamber 30 therewithin.

When the plunger 10 is falling or descending through a tubing string or line in a gas or oil well "W", as represented by the arrow "F" in FIG. 3, the shift rod 40 is effected downwardly, so as to have its lower end extend beyond the lower end 10 of the plunger body 10, so that a portion of the spacer fins 52 extend therefrom. There is an annular passageway 56 of diameter "D3", between the shift rod 40 and the interior cavity 24 of the plunger 10. Fluid is permitted to enter this annular passageway 56 between the shift rod 40 and the interior bore or cavity 24 of the plunger 10, via entry between the adjacent spaced apart fins 52, and travels through the generally longitudinally directed bores 48 arranged within the valve body 30. That fluid is then permitted to escape out the exterior holes 32 through the plunger wall at the upper end 14 of the enlarged chamber or cylinder cavity 30 in which the valve body 46 reciprocally travels, thus making the plunger's fall or downward travel through the tubing string or well "W" much faster, thereby reducing its operation cycle time, thus improving the output of the oil or gas well. The shift rod 40 may be maintained in that lowermost orientation, with its lowermost and extending through the lowermost end 18 of the plunger body 12, (as represented in FIG. 3) in one preferred embodiment, by virtue of the ball 54 being biased in the uppermost or first annular detent 42 at the uppermost end of the shift rod 40.

When the plunger strikes the bottom hole bumper or spring stop 60 at the lower end of the string or well "W", represented in FIG. 3, the shift rod 40 is struck, and by impact force, is caused to be moved longitudinally (upwardly, and in a new later cycle, downwardly) within the inner elongated cylindrical bore 24 of the plunger 10, thus driving the valve body 46 upwardly towards the upper end 14 of the plunger 10 and towards the upper end of the enlarged chamber 30, effectively blocking off the upper ends of the bores 48 and also the sidewall fluid escape holes 32 thus preventing fluid from escaping the plunger 10 and that enlarged chamber 30 thereadjacent, as represented in FIG. 2. Thus, fluid/gaseous pressure may be caused to build up within the plunger 10 and around its outer rings 20 externally thereof, and advance the plunger 10 cyclically towards the upper end of the oil/gas well so as to strike the lubricator 62, by the upper or tip end 80 of the shift rod 40, as represented in FIG. 2, and thus go through its operating cycle again. During the plunger's upward travel within the tubing string, the shift rod 40 may be held in its upward orientation by virtue of the biased ball 54 being pressed into the second or lowermost annular detent 44 which is longitudinally beneath the first or upper annular detent 42.

A further embodiment for changing the direction and position of the shift rod 40, comprises an electromagnetic signal generator such as for example, an induction coil 64 arranged within the shift rod 40, which would effect a movement of that shift rod 40, by a solenoid effect, when it passed thru a corresponding coil 66 or an RF generator or the like in another aspect of the invention, at an appropriate location within the casing of the well "W" as represented in FIG. 3.

The invention claimed is:

1. An elongated plunger arrangement for moving up and down in a tubing string and a plunger lift system for an oil well and a gas well, the plunger having an upper portion, an intermediate portion and a lower portion, all of the portions having an elongated longitudinally directed cavity extending the full length of the plunger, the plunger also having a direction accelerating arrangement, the direction accelerating arrangement comprising:

an elongated acceleration inducing ball and detent axial-position-securable shift rod extending through the elongated cavity, wherein the shift rod is longer than the elongated plunger so as to extend out beyond only one end of the plunger at a time, the shift rod having a cylindrical array of multiple bore openings in parallel alignment with one another in a valve body manifold slidably arranged within an enlarged chamber adjacent the upper end of the shift rod, an arrangement of circumferentially spaced-apart fluid flow permitting fins at the lower end of the shift rod, wherein fluid flows between the spaced-apart fins at the lower end of the shift rod and through the array of parallel, multiple bore openings the valve body manifold during a downward fall of the plunger arrangement; and a signal generator arranged in the lower end of the plunger in communication with a corresponding signal generator in the lower end of the well to effect movement of the shift rod.

2. The elongated plunger arrangement as recited in claim 1, wherein the valve body is longitudinally displaceable within an enlarged cavity within the upper end of the plunger.

3. The elongated plunger arrangement as recited in claim 2, wherein the large cavity within the upper end of the plunger has a controlled fluid discharge arrangement therein.

4. The elongated plunger arrangement as recited in claim 3, wherein of the controlled fluid discharge arrangement comprises at least one gas exit port arranged through the wall of the upper end of the plunger body.

5. A method of accelerating the fall of an elongated plunger in the casing of an oil or gas well system, comprising:

arranging an elongated, axially displaceable shift rod within an elongated longitudinally directed cavity of the plunger, which shift rod is longer than the elongated plunger;

extending the elongated shift rod downwardly beyond the lower end of the elongated plunger during a fall of that plunger within an oil or gas well system;

opening a valve within that plunger during that fall the plunger so as to permit a gaseous flow of fluid through the plunger during its descent in the well; and arranging a signal generator in the lower end of the shift rod and a corresponding signal generator in the lower end of the casing to create a solenoid effect between the signal generator in the casing and the shift rod when the plunger passes through the signal generator in the lower end of the casing.

6. The method as recited in claim 5, including:

impacting the lower end of the well by the lower end of the shift rod so as to axially displace the shift rod upwardly secured within the body of the plunger from the first annular detent to a second annular detent.

7. The method of as recited in claim 6, wherein the upward displacement of the shift rod action to close the valve in the plunger thereby shuts off the flow of gas through that plunger in its ascent back up to the top of the well.

8. An elongated plunger arrangement for moving up and down in a tubing string of a plunger lift system for an oil/gas well, the plunger having an upper end and a lower end, the plunger having an elongated longitudinally directed bore extending the full length of the plunger, the plunger also having an elongated direction-accelerating shift rod valve member reciprocably arranged within the elongated bore, the elongated shift rod having a length which is longer than the length of the elongated bore within the plunger, the shift rod having a signal generating coil disposed therearound, the tubing string having a corresponding signal generating coil disposed therearound at a lower end thereof so as to create a solenoid effect between the coil on the shift rod and the coil in the tubing string.

9. The elongated plunger arrangement as recited in claim 8, wherein the shift rod has a lower end which strikes the lower end of the tubing string first before the lower end of the plunger strikes the lower end of the tubing string.

10. The elongated plunger arrangement as recited in claim 9, wherein the shift rod has a lower end with an arrangement of fins thereon.

* * * * *